United States Patent [19]

Sakuma

[11] Patent Number: 4,905,911

[45] Date of Patent: Mar. 6, 1990

[54] FAN-SPRAY NOZZLE

[75] Inventor: Hideo Sakuma, Kanagawa, Japan

[73] Assignee: Shimon Kabushiki Kaisha, Tokyo, Japan

[21] Appl. No.: 309,891

[22] Filed: Feb. 7, 1989

Related U.S. Application Data

[63] Continuation of Ser. No. 144,498, Jan. 15, 1988, abandoned.

[30] Foreign Application Priority Data

Jan. 19, 1987 [JP] Japan ..... 62-9649

[51] Int. Cl.[4] ..... B05B 1/04

[52] U.S. Cl. ..... 239/599; 239/DIG. 14

[58] Field of Search ..... 239/592, 594, 595, 599, 239/568, 597, DIG. 14

[56] References Cited

U.S. PATENT DOCUMENTS

| | | | |
|---|---|---|---|
| 2,284,443 | 5/1942 | Paradise | 239/597 X |
| 2,745,701 | 5/1956 | Wahlin | 239/597 |
| 3,659,787 | 5/1972 | Ito | 239/599 X |
| 3,858,812 | 1/1975 | Williams et al. | 239/599 |
| 4,097,000 | 6/1978 | Derr | 239/599 |

FOREIGN PATENT DOCUMENTS

| | | | |
|---|---|---|---|
| 441542 | 6/1925 | Fed. Rep. of Germany | 239/592 |
| 51857 | 9/1985 | Japan . | |

*Primary Examiner*—Andres Kashnikow
*Assistant Examiner*—Kevin P. Weldon
*Attorney, Agent, or Firm*—Pearne, Gordon, McCoy & Granger

[57] ABSTRACT

A fan-spray nozzle capable of preventing generation of tailing and improving spraying of paint, as well as being readily manufactured. In the nozzle, a through-hole of a cylindrical section is formed so as to have a cross-sectional area larger than that of a hemispherical depression formed in a dome section and at a front end thereof into a substantially elliptical or oval shape in cross section. The oval-shape has a minor axis portion formed so as to have a length equal to the diameter of the depression so that the through-hole may be smoothly connected to the hemispherical depression at the minor axis portion. The semicircular groove is formed so as to extend in a direction substantially perpendicular to the minor axis portion of the oval shape and is also formed so as to have a bottom which is formed into an acute shape and terminates at substantially the same level as a step formed between a major axis portion of the oval-shaped cross section of the front end of the through-hole and the depression or thereabove.

8 Claims, 1 Drawing Sheet

FAN-SPRAY NOZZLE

This is a continuation of application Ser. No. 07/144,498 filed on Jan. 15, 1988 now abandoned.

BACKGROUND OF THE INVENTION

1. Field of the Invention

This invention relates to a fan-spray nozzle, and more particularly to a fan-spray nozzle which is suitable for use for finish coating.

2. Description of the Prior Art

A fan-spray nozzle which has been conventionally used to prevent generation of tailing is typically constructed in such a manner as disclosed in Japanese Patent Publication No. 51857/1985.

More particularly, the conventional fan-spray nozzle includes a dome section and a cylindrical section connected to rear end of the dome section so as to rearwardly extend therefrom. The dome section is provided therein with a hemispherical depression and the cylindrical section is provided therein with a cylindrical through-hole communicated with the depression, so that a flow passage extending through the nozzle may be defined therein. The dome section is also formed with a groove of a V-shape in section. The V-shaped groove is communicated with the depression, so that it may constitute a lip-like orifice-type injection hole in cooperation with the depression. The hemispherical depression of the nozzle is formed to have a diameter smaller than that of the through-hole of the cylindrical section, so that a step may be formed at a connection between the depression and the through-hole which serves as a corner in the flow passage. The V-shaped groove is formed to have a depth which causes it to intersect with the step in a predetermined manner. Also, the nozzle is provided at a proximal end of the cylindrical section with an inlet passage, which extends in a lateral direction of the nozzle so as to cause flow of fluid flowing therethrough into the nozzle to be abutted against each other.

In the conventional fan-spray nozzle constructed as described above, it is required that formation of the step is carried out with high accuracy. Also, it is required that formation of the V-shaped groove is carried out to provide the groove with an acute bottom and intersection between the groove and the shoulder is dimensionally accurately carried out. Thus, it will be noted that the conventional fan-spray nozzle is difficult and troublesome to be manufactured. Also, elimination of the inlet passage from the nozzle readily leads to generation of tailing.

Accordingly, it would be highly desirable to develop a fan-spray nozzle which is simplified in structure and readily manufactured while improving spraying and effectively preventing generation of tailing.

SUMMARY OF THE INVENTION

The present invention has been made in view of the foregoing disadvantages of the prior art.

The inventor has found that a fan-spray nozzle wherein a lip-like injection hole is formed due to intersection between a hemispherical depression and a V-shaped groove generally generates tailing for the following reasons.

When the V-shaped groove is formed so as to have a bottom of an appropriate depth and a step is formed in excess between the hemispherical depression and a through-hole of a cylindrical section, or such a step is not formed, such a spray pattern as shown in FIGS. 1 or 2 is obtained. On the contrary, when the step is properly formed and the V-shaped groove is insufficiently or excessively formed, a spray pattern as shown in FIG. 3 or 4 is formed. More specifically, provision of the step causes a spray pattern forming element to be separated into a spray pattern forming portion and a tail forming portion. The tail forming portion is then separated into two or bifurcated, one of which outwardly points in a direction away from an end of the spray pattern forming portion and the other of which points toward the spray pattern forming portion. It is supposed that adequate formation of the step and V-shaped groove causes a very slight amount of the tailing forming portion to be formed and divided into two. What can be actually observed is only one which outwardly points away from the spray pattern forming portion. Although it is formed at a proximal end thereof into a strip-like shape, it scatters immediately after ejection from the injection hole and extinguishes while being caught in the spray pattern forming portion immediately before it reaches a surface of a material to be sprayed.

In view of the foregoing, it is believed that generation of tailing would be effectively prevented by spraying liquid from the injection nozzle while eliminating bifurcation of liquid occurring at the bottom of the V-shaped groove due to collision of components of the liquid which merge from both sides of the step. Also, it is believed that a decrease in flow resistance in the cylindrical through-hole in the cylindrical section and formation of turbulence and vortex in liquid immediately before the lip-like injection hole would be more effective to prevent generation of tailing and improve spraying of the liquid.

Accordingly, it is an object of the present invention to provide a fan-spray nozzle which is capable of positively and effectively preventing generation of tailing.

It is another object of the present invention to provide a fan-spray nozzle which is capable of improving spraying of liquid.

It is a further object of the present invention to provide a fan-spray nozzle which is capable of being readily manufactured.

It is still another object of the present invention to provide a fan-spray nozzle which is capable of accomplishing the above-noted objects with a simple structure.

In accordance with the present invention, a fan-spray nozzle is provided. The nozzle includes a front nozzle section formed therein with a substantially hemispherical depression opened at a rear end thereof and formed at a front portion thereof with a substantially semicircular groove of a V-shape in section which is communicated with the depression to constitute a lip-like orifice-type injection hole in cooperation with the depression. Also, the nozzle includes a rear nozzle section connected to the front section and formed therein with a through-hole communicated with the hemispherical depression.

The through-hole of the rear nozzle section is formed so as to have a cross-sectional area larger than that of the hemispherical depression and at a front end thereof into a substantially elliptical or oval shape in cross section, and the oval shape of the front end of the through-hole has a minor axis portion formed into a length which permits the through-hole to be smoothly connected to the hemispherical depression through the minor axis portion.

The nozzle also includes a step formed between a major axis portion of the front end of the through-hole of the rear nozzle section and the hemispherical depression of the front nozzle section. The semicircular groove is formed so as to extend in a direction substantially perpendicular to the minor axis portion of the through-hole and have a bottom which is formed into an acute shape and terminates at substantially the same level as the step or thereabove.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a fan-spray nozzle according to the present invention will be described with reference to FIGS. 5 to 10.

Figure 5:
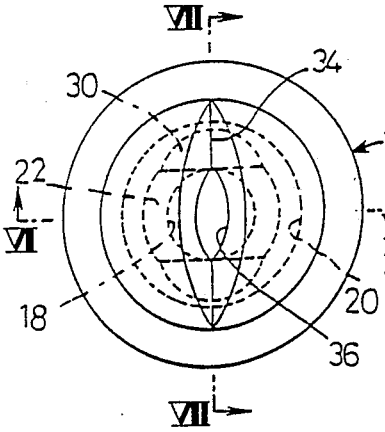
FIG. 5 is a plan view showing an embodiment of a fan-spray nozzle according to the present invention.
Figure 6:
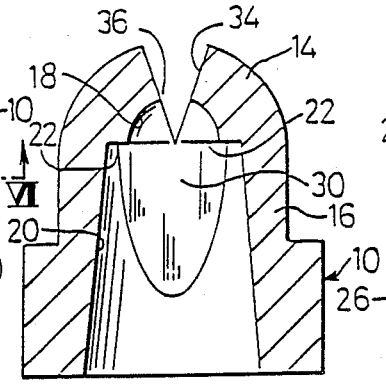
FIG. 6 is a sectional view taken along line VI—VI of FIG. 5.
Figure 7:
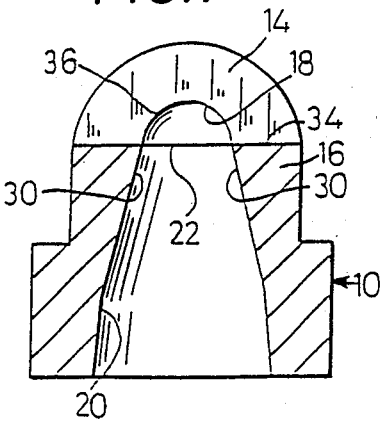
FIG. 7 is a sectional view taken along line VII—VII of FIG. 6.

FIGS. 5 to 7 show an embodiment of a fan-spray nozzle according to the present invention. A fan-spray nozzle of the illustrated embodiment, which is generally designated by reference numeral 10 in FIGS. 5 to 7, may be formed of a superhard material such as cemented carbide, ceramic or the like by means of such a core, as generally indicated at reference numeral 12 in FIG. 8, and includes a front nozzle section 14 and a rear nozzle section 16 which are formed together. In the illustrated embodiment, the front nozzle section 14 comprises a dome section which is formed therein with a substantially hemispherical depression 18 and the rear nozzle section 16 comprises a cylindrical section which is provided therein with a substantially frustoconical through-hole 20. A front end of the through-hole 20 has a transverse radius larger than that of the depression 18, and is communicated with the depression 18 through a step 22, so that a flow passage may be formed in the nozzle 10. In the illustrated embodiment, the depression 18, through-hole 20 and step 22 are formed by a hemispherical projection 24, a frustoconical portion 26 and a shoulder 28 of the core 12. Also, the frustoconical through-hole 20 is provided on each of both sides of an upper or front end portion thereof with a tongue-like straight guide 30, which, in the illustrated embodiment, is formed by a cutout 32 formed on each of both sides of an upper end portion of the frustoconical portion 26 of the core 12 so that the portion 26 may be smoothly connected to the hemispherical projection 24 through the cutout 32 without forming any discontinuity therebetween, as at area 40. The straight guide 30 has the thickness gradually decreased in a downward or rearward direction. This results in the upper end of the through-hole 20 being formed transversely into a substantially elliptic or oval shape in cross section, of which a minor axis portion has a length substantially equal to the diameter of the hemispherical depression 18, so that the through-hole 20 may be smoothly connected at its minor axis portion to the hemispherical depression 18 without discontinuity, as shown in FIG. 7. This results in the step 22 being separated into two portions opposite to each other through the straight guides 30. A major axis portion of the oval-shaped end of the through-hole 20 is connected to the depression 18 through the step 22, as shown in FIG. 6.

The dome section 14, as shown in FIGS. 5 and 6, is provided with a groove 34 which is generally formed into a semicircular shape as shown in FIG. 7, is V-shaped in section as shown in FIG. 6 and is formed into a substantially lip-like shape in plan view as shown in FIG. 5. The V-shaped groove 34 is also formed so as to be communicated with the hemispherical depression 18. Also, the groove 34 is formed so as to extend in a direction substantially perpendicular to the straight guide 30 or parallel to the minor axis of the oval-shaped end of the through-hole 20 and has a depth which terminates at substantially the same level as the step 22 or downstream thereof. The so-formed groove 34 constitutes a lip-like injection hole 36 in cooperation with the hemispherical depression 18.

Figure 1:
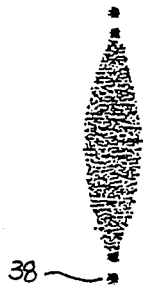
FIG. 1 PRIOR ART
FIGS. 1 to 4 each are a schematic view showing a spray pattern of a prior art fan-spray nozzle.
Figure 2:
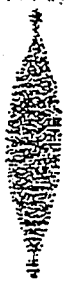
FIG. 2 PRIOR ART
Figure 3:
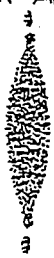
FIG. 3 PRIOR ART
Figure 4:
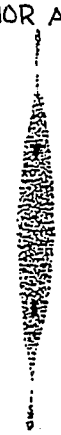
FIG. 4 PRIOR ART

In the fan-spray nozzle 10 constructed as described above, flow of liquid such as paint or the like supplied through a proximal open end of the through-hole 20 to the nozzle 10 under pressure is disturbed by the step 22 before it is ejected through the lip-like injection hole 36 without losing its pressure in the through-hole 20, so that turbulence and small vortices may be generated in the flow to promote spraying of the liquid and prevent generation of tailing 38, which tails are shown in the prior art spray pattern of FIG. 1. In particular, the illustrated embodiment is so constructed that both ends of the lip-like injection holes 36 are aligned at an intermediate position between the opposite portions of the step 22 and terminate at the straight guides 30. Such construction permits flows of liquid which are deflected by the opposite portions of the step 22 and collide with each other to collide with liquid flowing straight along the straight guide 30 without bifurcating, so that the liquid may be ejected from the injection hole 36 in the form of a fan-like shape. Thus, it will be noted that the illustrated embodiment effectively prevents generation of tailing and improves spraying.

Figure 8:
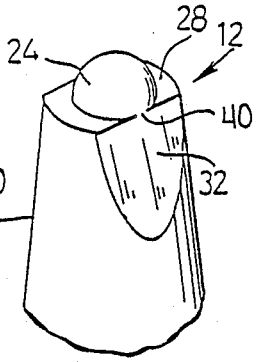
FIG. 8 is a perspective view showing a core which may be used for manufacturing the fan-spray nozzle shown in FIGS. 5 to 7.

The hemispherical depression 18, frustoconical through-hole 20, step 22 and straight guide 30 of the fan-spray nozzle 10 constructed as described above may be formed during a powder molding step using the core 12 shown in FIG. 8 before sintering.

Figure 9:
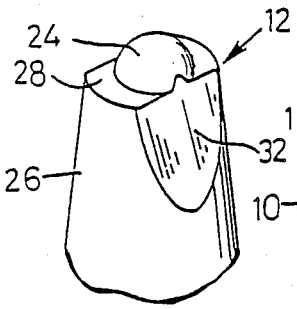
FIG. 9 is a perspective view showing a core which is adapted to manufacture another embodiment of a fan-spray nozzle according to the present invention.

The fan-spray nozzle of the present invention may be formed by means of a core as shown in FIG. 9. A core 12 of FIG. 9 is so constructed that each of cutouts 32 is formed so as to extend at a distal end thereof beyond a proximal end of a hemispherical projection 24. When the fan-spray nozzle of the present invention is formed by the core of FIG. 9, it is possible to avoid an intersection between the fan-shaped groove 34 and the step 22 even if the groove is formed so as to extend below a level of the step 22.

Figure 10:
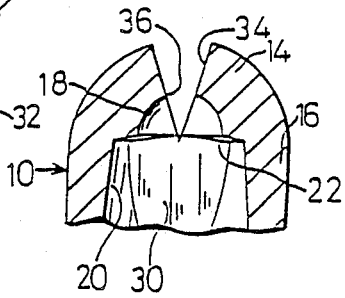
FIG. 10 is a fragmentary sectional view showing an essential part of a further embodiment of a fan-spray nozzle according to the present invention.

The fan-spray nozzle of the present invention may be constructed in such a manner as shown in FIG. 10. A nozzle 10 shown in FIG. 10 is so constructed that a step 22 is formed in a manner to be oblique with respect to the longitudinal axis of the nozzle.

In the present invention, it is desirable that a connection between the step 22 and the hemispherical depression 18 is formed so as not to have any radius. Also, it is desirable to form the V-shaped groove 34 with an acute bottom.

The fan-spray nozzle of the present invention constructed as described above causes liquid supplied to the flow passage in the nozzle to be substantially disturbed before it is ejected from the ejection hole, resulting in improving and promoting spraying of the liquid and preventing generation of tailing.

Also, in the present invention, formation of the step causes the frustoconical through-hole to have a much larger diameter than that of the hemispherical depression, so that flow resistance in the through-hole may be decreased to a degree sufficient to substantially restrain pressure loss of fluid flowing therethrough, resulting in spraying of the fluid being improved and promoted.

Further, the present invention is so constructed that the step is provided in proximity to the semicircular groove and the groove is formed so as not to intersect with the step. Such construction causes flow of liquid disturbed and deflected by the opposite portions of the step to collide with each other and then collide with liquid flowing along the straight guide at both ends of the lip-like injection hole, resulting in liquid being integrally sprayed from the injection hole without bifurcating and flattening. The inventor's experiment revealed that the embodiment shown in FIGS. 5 to 7, wherein the major axis portion of the oval-shaped upper end of the through-hole 20 is formed so as to have a length twice as large as the diameter of the hemispherical depression and the semicircular groove 34 is formed into a depth substantially equal to the level of the step 22, exhibits advantages highly superior to the convention nozzle disclosed in Japanese Patent Publication No. 51857/1985 wherein the lateral inlet passage is eliminated. More particularly, the conventional nozzle generated tailing 38 when it was used to spray melamine resin paint under pressure of 70 $kg/cm^2$, whereas the nozzle of the present invention never generated tailing even when it was used to spray it under pressure as low as 30 $kg/cm^2$.

In addition, in the present invention, the semicircular groove may be formed into any desired depth so long as it does not intersect with the step. Accordingly, the nozzle of the present invention can be readily manufactured.

Furthermore, the nozzle of the present invention is relatively simplified in structure, so that molding techniques may be effectively utilized for manufacturing the nozzle of the present invention.

While preferred embodiments of the present invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A fan-spray nozzle comprising:

a front nozzle section formed therein with a substantially hemispherical depression opened at a rear end thereof and formed at a front portion thereof with a substantially semi-circular groove of a V-shape in section which is communicated with said depression to constitute a lip-like orifice-type injection hole in cooperation with said depression;

a rear nozzle section connected to said front section and formed therein with a through-hole communicated with said hemispherical depression;

said through-hole of said rear nozzle section being formed so as to have a cross-sectional area larger than that of said hemispherical depression and at a front end thereof into a substantially elliptical or oval shape;

said oval-shaped cross section of said front end of said through-hole has a minor axis portion having a length which permits said through-hole to be smoothly connected to said hemispherical depression through said minor axis portion; and a step formed between a major axis portion of said oval-shaped cross section of said front end of said through-hole and said hemispherical depression;

said semicircular groove being formed so as to extend in a direction substantially parallel to said minor axis portion of said oval-shaped cross section of said through-hole;

said semicircular groove also being formed so as to have a bottom which is formed into an actual angle shape and terminates at substantially the same level as said step or downstream thereof.

2. A fan-spray nozzle as defined in claim 1, wherein said minor axis portion of said oval-shaped cross section of said through-hole is formed by straight guides provided on both sides of a wall of said through-hole.

3. A fan-spray nozzle as defined in claim 2, wherein said straight guides each are formed to extend beyond a proximal end of said hemispherical depression.

4. A fan-spray nozzle as defined in claim 1, wherein said minor axis portion of said oval-shaped cross section of said through-hole has a length substantially equal to the diameter of said hemispherical depression.

5. A fan-spray nozzle as defined in claim 1, wherein said step is obliquely formed.

6. A fan-spray nozzle as defined in claim 1, wherein a connection between said step and said hemispherical depression is formed so as not to have any radius.

7. A fan spray nozzle as defined in claim 1, wherein said through-hole has an inlet and an outlet end and is tapered from inlet to outlet end thereof with the outlet end being smaller.

8. A fan spray nozzle as defined in claim 1, wherein said through-hole is generally conical, smaller toward said outlet end, with an angle of the generatrix to the axis of between 10 and 15 degrees.

* * * * *